United States Patent [19]

Fukukura

[11] Patent Number: 4,488,016

[45] Date of Patent: Dec. 11, 1984

[54] MEMBRANE SWITCH HAVING CROSSING CIRCUIT CONDUCTORS

[75] Inventor: Kazutoyo Fukukura, Reading, Mass.

[73] Assignee: AMP Incorporated, Harrisburg, Pa.

[21] Appl. No.: 460,333

[22] Filed: Jan. 24, 1983

[51] Int. Cl.[3] ..... H01H 9/26

[52] U.S. Cl. ..... 200/5 A; 361/398

[58] Field of Search ..... 200/5 A, 86 R, 16 D, 200/292; 361/398

[56] References Cited

U.S. PATENT DOCUMENTS

| | | | |
|---|---|---|---|
| Re. 30,923 | 5/1983 | Durkee | 200/5 A |
| 3,860,771 | 1/1975 | Lynn | 200/159 B |
| 3,987,259 | 10/1976 | Larson | 200/5 A |
| 4,066,851 | 1/1978 | White | 200/5 A |
| 4,243,861 | 1/1981 | Strandwitz | 200/159 B |
| 4,258,096 | 3/1981 | LaMarche | 428/209 |
| 4,271,333 | 6/1981 | Adams | 200/5 A |
| 4,314,117 | 2/1982 | Ditzig | 361/398 |
| 4,317,013 | 2/1982 | Larson | 200/5 A |
| 4,391,845 | 7/1983 | Denley | 200/5 A |

*Primary Examiner*—E. A. Goldberg
*Assistant Examiner*—M. Reinhart
*Attorney, Agent, or Firm*—F. W. Raring

[57] ABSTRACT

Membrane switch assembly comprises a substrate, a separator, and a flexible membrane which is opposed to the substrate. Pairs of switch electrodes are provided on the substrate and commoning conductors are provided on the membrane so that flexure of the membrane against the substrate electrically commons the switch electrodes and closes the switch. The commoning conductor comprises two separate commoning pads which are connected by a bridging conductor on the membrane that extends circuitously between the commoning pads. There is a passageway between the commoning pads which is opposed to the passageway between the switch electrodes on the substrate. A circuit conductor can be provided on the substrate extending between the switch electrodes and this circuit conductor will not be contacted by the commoning conductor on the membrane when the switch is closed.

10 Claims, 6 Drawing Figures

MEMBRANE SWITCH HAVING CROSSING CIRCUIT CONDUCTORS

FIELD OF THE INVENTION

This invention relates to membrane switches of the type comprising a substrate, a membrane, and a separator between the membrane and the substrate. Spaced-apart switch electrodes are provided on the substrate and a commoning conductor is provided on the membrane so that flexure of the membrane towards the electrodes will electrically common the switch electrodes and close the switch. The invention is particularly directed to an improvement which avoids the use of jumper conductors in membrane switch devices.

BACKGROUND OF THE INVENTION

A conventional membrane switch may comprise a substrate, a separator, and a membrane having a surface which is opposed to the substrate. Circuitry is provided on the substrate including one or more switches, each of which comprises spaced-apart switch electrodes. The membrane has a commoning conductor thereon in opposed relationship to the electrodes so that the membrane can be flexed towards the substrate at the switch site and the switch electrodes will be electrically commoned by the commoning conductor thereby to close the switch. The commoning conductor usually comprises a conductive grid on the membrane extending over an area which encompasses both of the switch electrodes.

In the design of circuits for membrane switches, it is highly desirable to arrange the circuit such that it is not necessary to have the circuit conductors cross over each other. The circuitry on the substrate and on the membrane is commonly applied by a silk screening process using conductive inks and if none of the circuit lines cross each other, all of the circuits, including the conductors and the switch electrodes, can be applied to the substrate in a single silk screening operation.

Under some circumstances, it is impossible to avoid crossovers of conductors because of the arrangement of the conductors and the density or complexity of the circuit. If crossovers are required, it is common practice to provide an isolation layer of insulating material on the conductors of the substrate where the crossover is required. The jumper conductor or crossing conductor is then silk screened or otherwise applied to the surface of the isolation layer.

The use of isolation layers and crossing conductors greatly increases the manufacturing cost of membrane switches for the reason that an additional two steps are introduced into the manufacturing process, the application of the isolation layer and the provision of the crossing conductor on the isolation layer. The present invention is directed to the achievement of improvements to membrane switches which will reduce or eliminate the need for crossovers in circuits where such crossovers have previously been required.

A membrane switch assembly in accordance with the invention is of the type comprising a substrate having first and second switch electrodes thereon which are adjacent to, and electrically isolated from, each other at a switch site, and a membrane which is parallel to and adjacent to, the substrate. The membrane has a commoning conductor thereon at the switch site which is opposed to the first and second switch electrodes. Separator means are provided between the membrane and the substrate and serves to maintain the membrane in spaced relationship to the substrate, the separator means being discontinuous at the switch site so that the membrane can be flexed towards the substrate with resulting contact of both the first and second switch electrodes by the commoning conductor thereby electrically to common the first and second switch electrodes. The membrane switch assembly is characterized in that the substrate has a circuit conductor thereon which extends between the first and second switch electrodes and the commoning conductor comprises first and second commoning pads which are opposed to the first and second switch electrodes respectively, and which are separated from each other by a commoning conductor passageway which is opposed to the circuit conductor. The first and second commoning pads are electrically connected to each other by a bridging conductor on the membrane, the bridging conductor having first and second ends which are connected to the first and second commoning pads and has an intermediate portion which is located beyond the switch site. The intermediate portion extends over a portion of the membrane which is maintained in spaced relationship to the substrate by the separator means whereby upon flexure of the membrane in the vicinity of the switch site towards the substrate, the first and second commoning pads will contact the first and second switch electrodes thereby closing switch at the switch site, and the circuit conductor will not be contacted by the first and second commoning pads.

In accordance with further embodiments, the separator means comprises a separator film having an opening at the switch site and the substrate and the membrane comprise a single sheet of film which is folded along a fold line.

Figure 1:
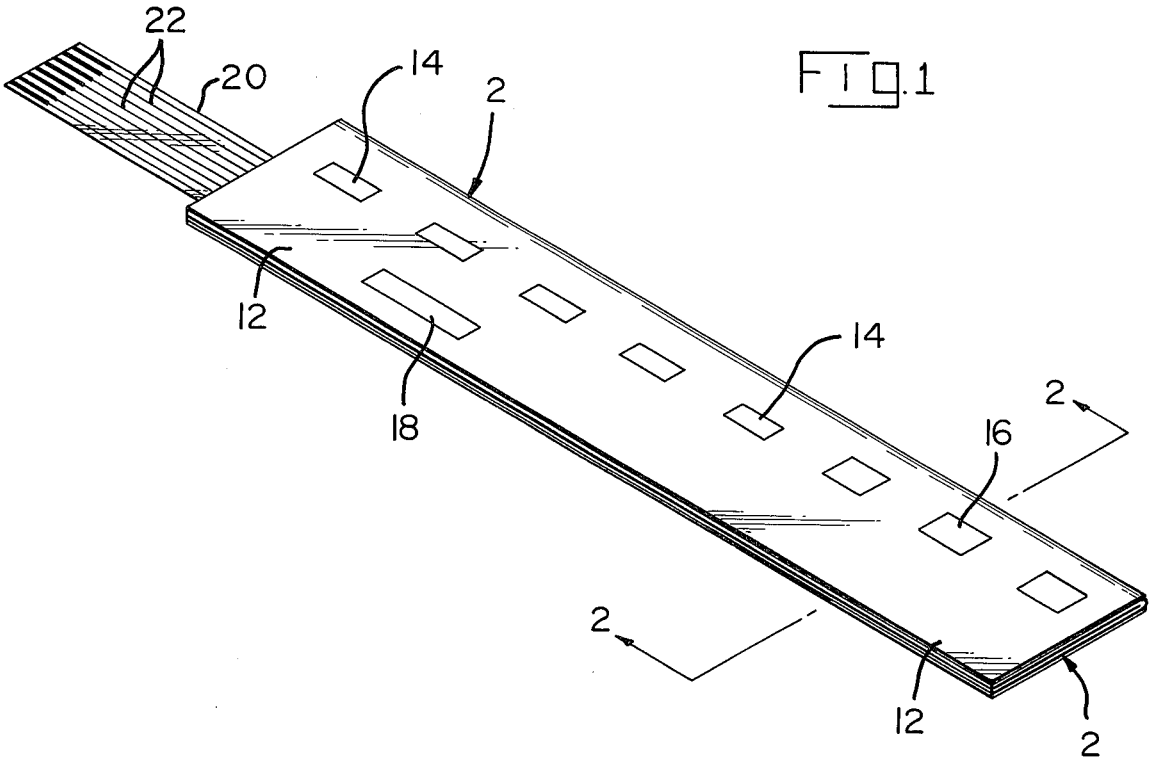
FIG. 1 is a perspective view of a switch assembly in accordance with the invention.
Figure 2:
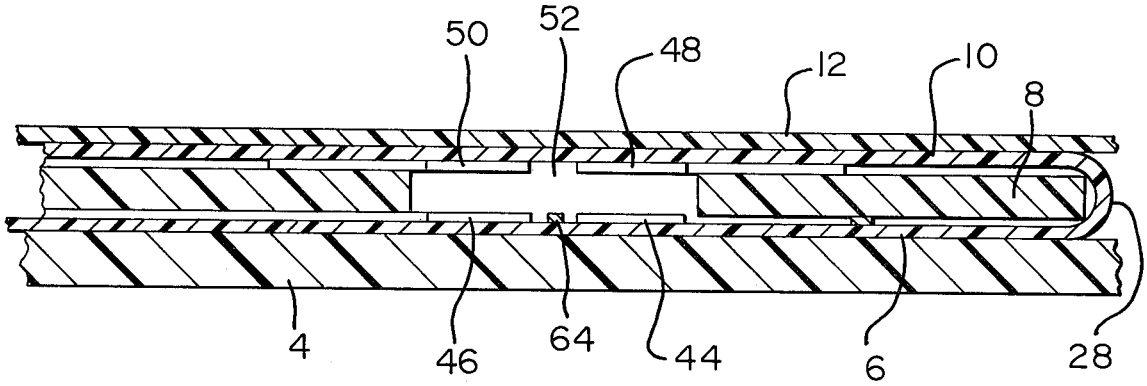
FIG. 2 is a cross-sectional view taken along the lines 2—2 of FIG. 1.

A switch assembly 2 in accordance with the invention (FIGS. 1 and 2) comprises a housing base or support 4, a substrate 6, a separator film 8, a membrane 10, and a cover 12, these parts being stacked on each other as shown in FIG. 2. The cover and the base enclose the membrane and the substrate and will be sealed along the edges of the assembly 2 in any suitable manner. The cover 12 has the switch sites identified thereon as shown at 14, 16, and 18 and a tail 20 extends from the substrate and has parallel conductors thereon as shown at 22. These conductors 22 would be connected to circuit or other conductors in the equipment on which the switch is used. As will be explained below, the switches at the switch sites 16 incorporate the principles of the present invention while the switches at sites 14 and 18 are of conventional design.

The part 6 of the assembly is herein identified as the substrate and the part 10 is identified as the membrane in the interest of clarity of the description. Both of these parts are in fact membrane films having conductors thereon and both of them are in a sense substrates in that conductors are provided on the surfaces.

Figure 3:
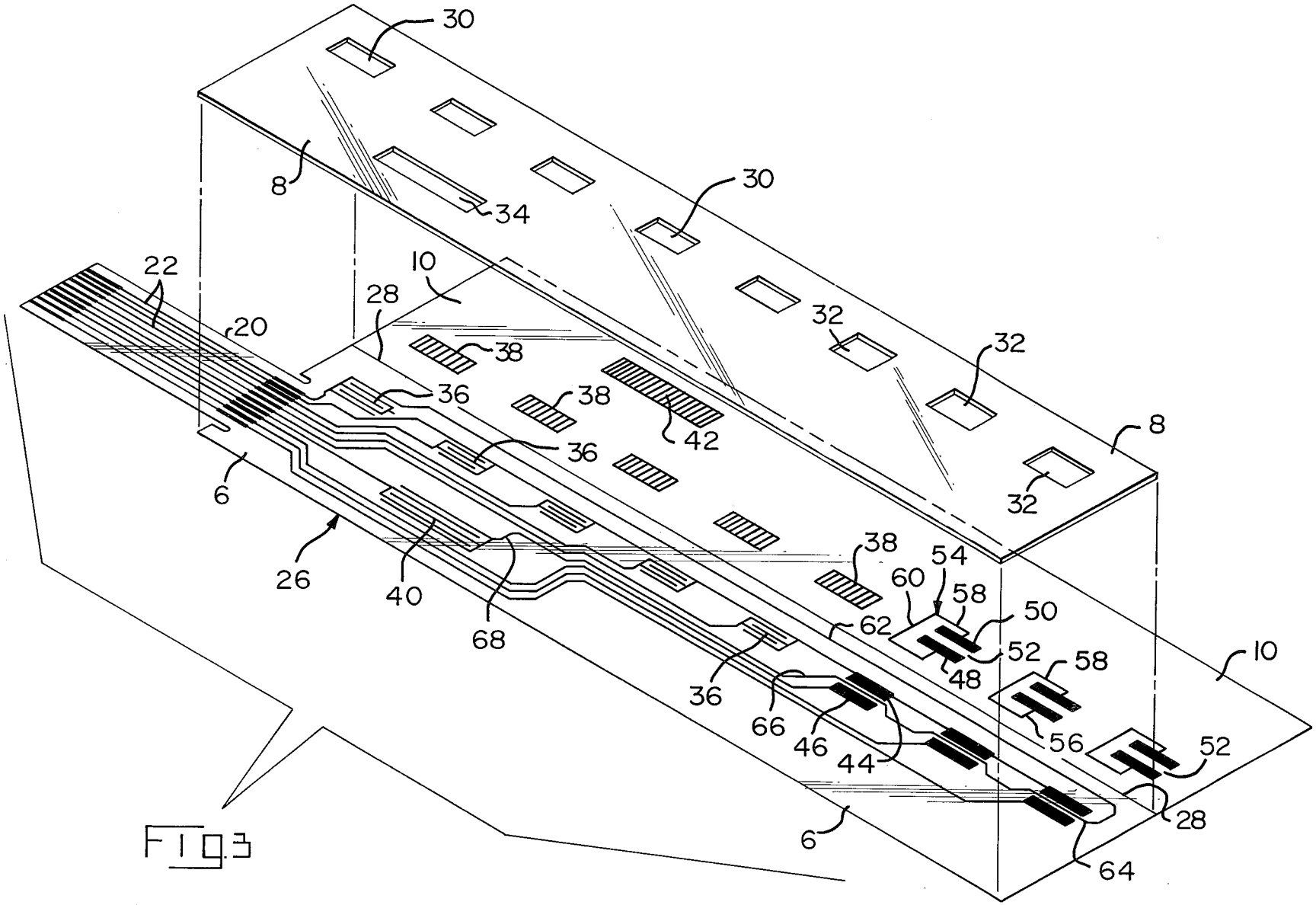
FIG. 3 is a perspective view of the substrate and the membrane portion of the switch assembly formed on a single sheet of film and showing the separator exploded from the substrate.
Figure 4:
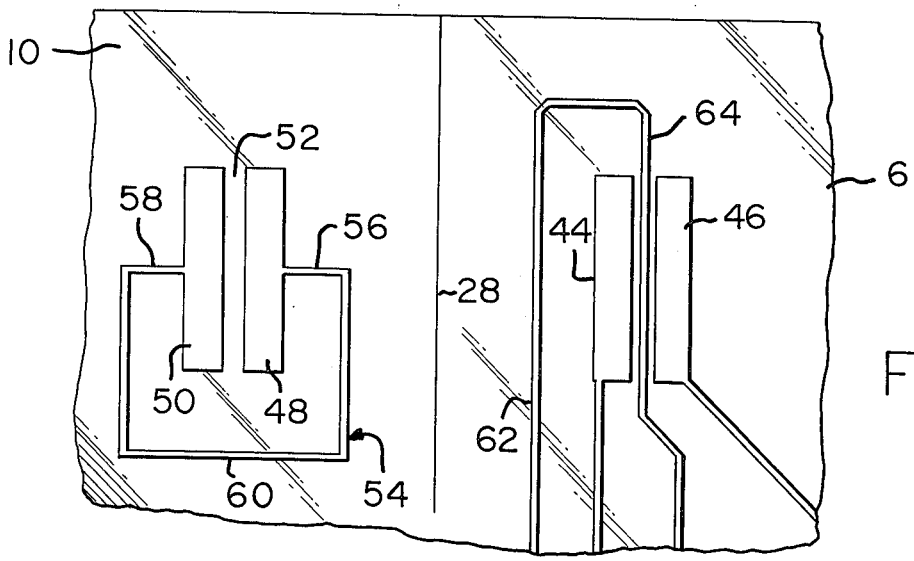
FIG. 4 is an enlarged plan view of a portion the substrate and the membrane prior to folding.

As shown in FIG. 3, the substrate and the membrane are formed from a single rectangular sheet of film 26 of polyester or other suitable material on which the circuit conductors, switch electrodes, and commoning conductors are of conductive ink and are silk screened on the surfaces. The conductors may also be electrodeposited. The sheet 26 of film is folded along a fold line 28 to locate the membrane 10 in opposed relationship to the substrate 6 with the separator film 8 positioned between the opposed surfaces. The separator film has openings 30 for the switches at the switch sites 14, openings 32 for the switches at the switch sites 16, and an opening 34 for the elongated switch site 18. Either the substrate or the membrane may be provided with venting passageways to permit flexure of the membrane.

The switch electrodes 36 for each of the switch sites 14 are provided on the substrate 6 and comprise interdigitated conductors 36 from which circuit conductors extend over the surface of the substrate and to the tail conductors 22. The commoning conductor 38 on the membrane 6 for each of the switch sites comprises a rectangular grid of conductors so that when the membrane is pressed through the corresponding opening 30, the interdigitated conductors will be connected to each other and the switch closed. This type of switch arrangement is common practice and is now widely used. The switch electrodes 40 at the switch site 18 are of the same general type but are elongated as compared with the electrodes 36 and the commoning grid 42 is similarly elongated. The electrodes and the commoning conductors for the switch sites 16 are in accordance with the present invention and will now be described in detail.

The switch electrodes for each of the switch sites 16 comprise first and second spaced-apart electrodes 44, 46 which are rectangular in the embodiment shown and which are separated by a passageway through which a circuit conductor 64 extends. The circuit conductor 64 forms no part of any of the switches at the sites 16 and must not be effected by closing of these switches.

Figure 5:
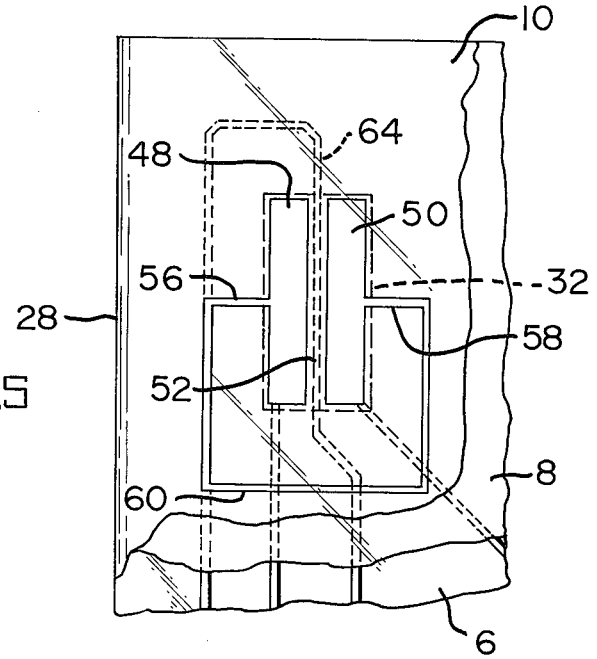
FIG. 5 is a view similar to FIG. 4 showing the relationship of the parts after folding.

The commoning conductor on the membrane 10 for each of the pairs of switch electrodes 44, 46 comprises first and second rectangular commoning pads 48, 50 which are opposed to the first and second switch electrodes 44, 46, respectively. The commoning pads are separated by a passageway 52 which, after folding of the sheet of film 26 is opposed to the passageway between the switch electrodes 44, 46. The commoning pads are connected to each other by a bridging conductor 54 which has a first end 56 that extends from the first pad 48 at a second end 58 that extends from the second pad 50. These ends of the bridging conductor extend from the side edges of the pads 48, 50 which are remote from the passageway 52. The end portions of the bridging conductor are connected by an intermediate portion 60 which extends beyond the ends of the commoning pads and which lies beyond the limits of the opening 32 in the separator. As shown in FIG. 5, after folding of the sheet 26 of film, the commoning pads 48, 50 will not overlie the passageway between the switch electrodes 44, 46 and the intermediate portion 60 of the bridging conductor is beyond the edges of the opening 32 so that this intermediate portion is against the separator film 8 and does not contact any of the circuit conductors on the substrate 6.

By virtue of the structure of the switch electrodes and the commoning conductor as described above, it is possible to provide a conductor on the substrate 6 extending from the left-hand switch site 14 to the elongated switch site 18 without crossing any of the circuit conductors. This conductor has a portion 62 which extends from one of the switch electrodes 36 parallel to the fold line and beyond the pairs of switch electrodes 44, 46. The conductor extends in a reverse direction adjacent to the right-hand end of the substrate as shown at 64 and lies between the pairs of switch electrodes 44, 46. The end portions 66, 68 of this conductor extend to one of the switch electrodes shown at 40. As explained above, this conductor 64 is not contacted when any of the switches at switch sites 16 are closed.

Figure 6:
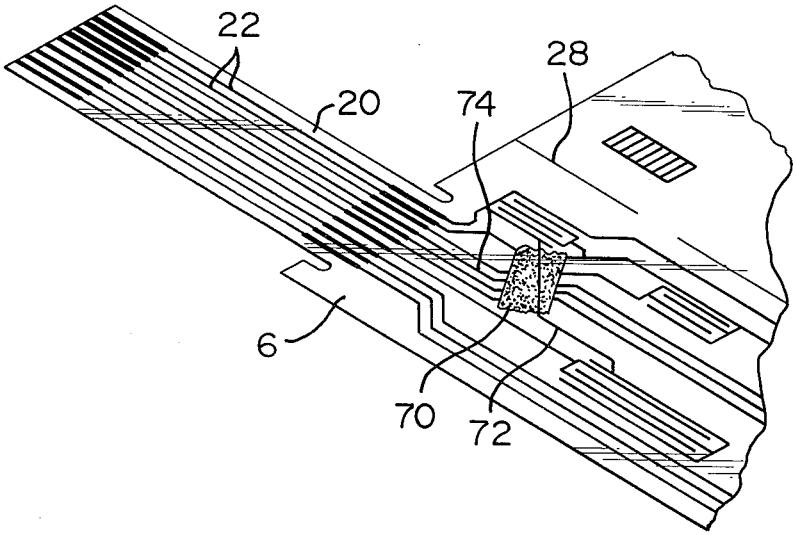
FIG. 6 PRIOR ART
FIG. 6 is a fragmentary view showing a portion of the substrate and membrane of FIG. 3 and illustrating the prior art technique of providing crossing conductors.

It will be apparent from careful inspection of FIGS. 1 and 3 that if the switch electrodes below the switch site 16 were of the type shown at 36 in FIG. 3, it would be impossible to route the circuit conductor 62, 64, 66, and 68 to the switch electrodes 40 without crossing several circuit conductors. FIG. 6 shows the prior art method of providing a conductor serving the same function as the conductor 62–68. In FIG. 6, an isolation layer of insulating material 70 is provided on a group of circuit conductors shown at 74 and a jumper conductor 72 can then be provided which extends from one of the electrodes 36 to one of the electrodes 40.

The savings which can be realized by the practice of the invention will be apparent by a consideration of the extra manufacturing steps which are required in the prior art manufacturing process. The present invention completely eliminates the step of providing the isolation layer 70 and the step of providing a conductor 72 in an additional manufacturing operation.

The embodiment of the invention disclosed herein has a relatively simple circuit and was chosen for the reason that it shows conventional switch sites 36, so that they can be compared with switch electrodes 44, 46 in accordance with the invention. The present invention will be found to be extremely useful in more complex circuits where many jumpers would be required of the type shown in FIG. 6.

I claim:

1. A membrane switch assembly of the type comprising a substrate having first and second switch electrodes thereon which are adjacent to, and electrically isolated from, each other at a switch site, a membrane which is parallel to and adjacent to, the substrate, the membrane having a commoning conductor thereon at said switch site which is opposed to the first and second switch electrodes, separator means between the membrane and the substrate serving to maintain the membrane in spaced relationship to the substrate, the separator means being discontinuous at the switch side so that the membrane can be flexed towards said substrate with resulting contact of both the first and second switch electrodes by the commoning conductor thereby electrically to common the first and second switch electrodes, the membrane switch assembly being characterized in that:

the substrate has a circuit conductor thereon which extends between the first and second switch electrodes, the commoning conductor comprises first and second commoning pads which are opposed to the first and second switch electrodes respectively, and which are separated from each other by a commoning conductor passageway which is opposed to the circuit conductor, the first and second commoning pads are electrically connected to each other by a bridging conductor on the membrane, the bridging conductor having first and second ends which are connected to the first and second commoning pads and having an intermediate portion which is located beyond the switch site and which extends over a portion of the membrane which is maintained in spaced relationship to the substrate by the separator means whereby upon flexure of the membrane in the vicinity of the switch site towards the substrate, the first and second commoning pads will contact the first and second switch electrodes thereby closing switch at the switch site, and the circuit conductor will not be contacted by the first and second commoning pads.

2. A membrane switch assembly as set forth in claim 1 characterized in that the separator means comprises a separator film having an opening therein at the switch site.

3. A membrane switch assembly as set forth in claim 1 characterized in that the substrate and the membrane comprise a single sheet of film which is folded along a fold line that connects the substrate to the membrane.

4. A membrane switch as set forth in claim 1 characterized in that the first and second switch electrodes are rectangular and the first and second commoning pads are rectangular.

5. A membrane switch assembly as set forth in claim 1 characterized in that the first and second commoning pads have adjacent edge portions which are on each side of the commoning conductor passageway and remote edge portions which are remote from the passageway, the first and second ends of the bridging conductor being connected to the remote edge portions of the first and second commoning pads respectively.

6. A membrane switch assembly as set forth in claim 5 characterized in that the separator means comprises a separator film having an opening therein at the switch site.

7. A membrane switch assembly as set forth in claim 6 characterized in that the substrate and the membrane comprise a single sheet of film which is folded along a fold line that connects the substrate to the membrane.

8. A membrane switch as set forth in claim 7 characterized in that the first and second switch electrodes are rectangular and the first and second commoning pads are rectangular.

9. A membrane switch as set forth in claim 1 characterized in that the electrodes, the commoning conductors, and the circuit conductors are of conductive ink.

10. A membrane switch as set forth in claim 1 characterized in that the electrodes, the commoning conductors, and the circuit conductors are of deposited metal.

* * * * *